United States Patent [19]

Hartshorn et al.

[11] 4,400,839

[45] Aug. 30, 1983

[54] MACHINE FOR LASTING HEEL SEAT PORTIONS OF SHOES

[75] Inventors: Frank Hartshorn, Wigston; Ivor J. R. le Vesconte, Birstall; Brian J. M. Murphy, Leicester; Richard E. Storer, Syston, all of England

[73] Assignee: USM Corporation, Farmington, Conn.

[21] Appl. No.: 342,712

[22] Filed: Jan. 25, 1982

[30] Foreign Application Priority Data

Jan. 26, 1981 [GB] United Kingdom ..... 8102298

[51] Int. Cl.[3] ..... A43D 21/00; A43D 89/00; A43D 3/00

[52] U.S. Cl. ..... 12/12.5; 12/14.2; 12/14.4; 12/33.6; 12/127

[58] Field of Search ..... 12/12.5, 14.2, 14.4, 12/123, 33.6, 12.3, 125, 126, 127

[56] References Cited

U.S. PATENT DOCUMENTS

| | | | |
|---|---|---|---|
| 2,262,756 | 11/1941 | Finn | 12/33.6 |
| 3,444,571 | 5/1969 | Harriman et al. | 12/12.5 |
| 3,579,695 | 5/1971 | Boot et al. | 12/127 |

*Primary Examiner*—Patrick D. Lawson

[57] ABSTRACT

In tack seat lasting machines, operator skill is often required because of irregularities in last manufacture, especially in drilling the last pin hole. Thus, automatic presentation is difficult. In accordance with the invention the last pin (32') is mounted for limited rocking movement about an axis extending lengthwise of the shoe bottom, and shoe centralizing means (424) engages edges of the shoe, at opposite sides of the last pin, to ensure alignment with a longitudinal center line of the machine. The centralized shoe is then clamped by a holddown (406), the centralizing means released, and the shoe heel end clamped by a heel band (520) which, by equalized pressure being applied to both "legs" thereof, holds, the shoe in position as presented.

6 Claims, 5 Drawing Figures

122
120
100
102
20
48
186
188
106
58
192
32
30
104
194
56
190
26
108
III
III
14
34
196
24
52
46
54
118
114
60
42
50
44
76
80
116
194
38
36
74
78
88
82
84
208
40
18
38
40
22
184
92
62
86
18
90
194
64
98
198
200
18
200
204
66
112
198
202
68
28
16
96
110
72
94
70
182

MACHINE FOR LASTING HEEL SEAT PORTIONS OF SHOES

BACKGROUND OF THE INVENTION (1) Field of the Invention

This invention is concerned with a machine for lasting heel seat portions of shoes. The term "shoe" where used herein is used generically as indicating articles of outer footwear generally, and as including an article of outer footwear in the course of its manufacture.

(2) Prior Art

In lasting heel seat portions of shoes, especially using metallic fasteners, e.g. tacks, a problem frequently arises in ensuring that the heel seat of the shoe is correctly aligned with heel seat lasting instrumentalities, prior to fastener insertion. One reason for this problem resides in that conventionally the shoe is supported on a last pin, which is accommodated in an appropriately positioned hole in the cone of the last, that such holes, however, often being carelessly drilled with a result that they are either not arranged with their longitudinal axis normal to the surface of the cone of the last, or not positioned centrally of the cone, or both. Where location relies on the position of the last pin hole, therefore, misalignment of the shoe with the heel seat lasting instrumentalities readily arises.

In order to overcome these problems, it has been proposed in a number of cases to enable the last pin to rock about an axis extending lengthwise of the shoe bottom, the usual intention being that the operator will, as he presents the shoe to the heel seat lasting instrumentalities, or to a heel band arrangement prior to presentation to such instrumentalities, orient the heel seat in such a manner, using the rocking capability of the last pin, that the marginal portions of the heel seat are appropriately positioned in relation to the heel seat lasting instrumentalities, and thus to the nail pattern, i.e. in which the fasteners are to be inserted.

Whereas it is acceptable to rely on operator skill to ensure that the shoe is properly presented in machines which are manually operated, such an arrangement is not acceptable in an automatic machine, i.e. a machine in which no operator is used. It is therefore the object of the present invention to provide an improved lasting machine in which shoes can be reliably presented automatically to the heel seat lasting instrumentalities.

BRIEF SUMMARY OF THE INVENTION

The invention thus provides a machine for lasting heel seat portions of shoes, comprising: shoe support means, comprising a heel support, including a last pin which is mounted for limited rocking movement about an axis extending lengthwise of the bottom of a shoe supported thereby, and toe support means, including a toe support member which can be urged upwardly against the toe cap portion of a shoe supported on the last pin, thus to set the toe-to-heel orientation of the shoe bottom, shoe centralizing means, comprising two shoe-engaging elements, arranged to engage the heel seat of the shoe at opposite sides of the last pin, said elements being movable through equal distances thus to engage and centralize the shoe in relation to a longitudinal center line of the machine, by rocking it together with the last pin, about said axis, a holddown member which engages the shoe bottom in the heel seat region thereof, while the shoe is held by the shoe centralizing means, a heel band arrangement, between which and the shoe support means relative movement of approach can take place, after withdrawal of the shoe centralizing means, thus to cause the heel end of the shoe engaged by the holddown member to be clamped by a heel band of said arrangement, in the operation of which arrangement equalized pressure is applied to opposite "legs" of the heel band so that the shoe is clamped substantially in the position in which it is presented to the heel band arrangement, and heel seat lasting instrumentalities by which lasting marginal portions of the upper are wiped over and pressed against corresponding marginal portions of the insole.

By the arrangement thus described, it will be seen that regardless of the heel pin hole position in the last cone, the heel seat of the shoe is accurately aligned with the longitudinal center line of the machine, and further by using the heel band arrangement above described, the action of the heel band in clamping the shoe prior to the operation of the heel seat lasting instrumentalities will not dislodge the shoe from its center line position.

The machine according to the invention may be of the type in which the heel band arrangement and the heel seat instrumentalities are mounted on a carriage which is movable towards the last support, thus to bring the heel band into clamping engagement with the shoe. In such machine, furthermore, conveniently the shoe centralizing means may also be mounted on said carriage, the arrangement being such that the elements of the shoe centralizing means are moved to out-of-the-way position prior to initiation of movement of the carriage. In this manner, the shoe centralizing means cannot interfere with the heel seat lasting operation as it proceeds. Conveniently, furthermore, the elements are resiliently urged into their out-of-the-way positions, fluid pressure operated means being provided for moving them into operative position.

The heel band arrangement of the machine in accordance with the invention preferably comprises heel band actuating means, comprising two lever arrangements acting one on each "leg" of the heel band, for moving said "legs" against opposite sides of the heel end of a shoe carried by the shoe support, thus to clamp the shoe thereon, said means also comprising a pressure compensating arrangement whereby the pressure applied to the "legs" by said means is equalized, each lever arrangement being actuated by a wedge member movable relative thereto, and the pressure compensating arrangement comprising a piston-and-cylinder arrangement mounted between the two wedge members and effective to cause them to be moved relative to the lever arrangements. Conveniently, furthermore, each lever arrangement comprises a first lever acting on the "leg" of the heel band and a second lever engageable by the wedge member, the two levers being pivoted on a common axis and adjustable stop means being provided for varying the angular relationship therebetween.

The last pin of the last support of the machine according to the invention is conveniently is carried on a block mounted for limited pivotal movement in a cradle, which is mounted for limited sliding movement, in a direction extending widthwise of the shoe bottom, in a further support block, locking means being provided whereby the first-mentioned block can be locked in adjusted widthwise position. Furthermore, the further support block itself may have, extending lengthwise of the shoe bottom, a curved abutment surface engaging a complementarily curved surface of a support member of the last support, the arrangement being such that adjusting movement of the support block on the support member varies the heightwise position of the toe of a shoe supported on the last pin, locking means being provided whereby the support block can be locked in adjusted position on the support member. Conveniently, the setting of the cradle, widthwise of the shoe bottom, is to compensate for the difference, widthwise of the longitudinal center line of the machine, between the longitudinal center line of the cone of the last and the longitudinal center line of the heel seat of the shoe bottom. The adjustment of the further support block, on the other hand, is merely to account for different styles of shoes, more especially according to the heel height of the finished shoe.

In order adequately to support the last on the last pin, preferably a last support plate is provided on the last support, to be engaged by the cone of a last placed on the last pin, said support plate being mounted for universal movement in relation to the last pin. In addition, the under-side of the support plate may have a part-spherical recess cooperating with a complementarily shaped surface of the first-mentioned block and also has an enlarged aperture through which the last pin projects, the plate also being resiliently secured on the block. Thus, regardless of the orientation of the last on the last support, an overall surface contact can be achieved between the shoe-engaging surface of the support plate and the corresponding surface of the cone of the last.

BRIEF DESCRIPTION OF THE DRAWINGS

There now follows a detailed description, to be read with reference to the accompanying drawings, of one machine in accordance with the invention, which machine has been selected for description merely by way of examplification of the invention and not by way of limitation thereof.

In the accompanying drawings.

DESCRIPTION OF THE PREFERED EMBODIMENTS

Figure 1:
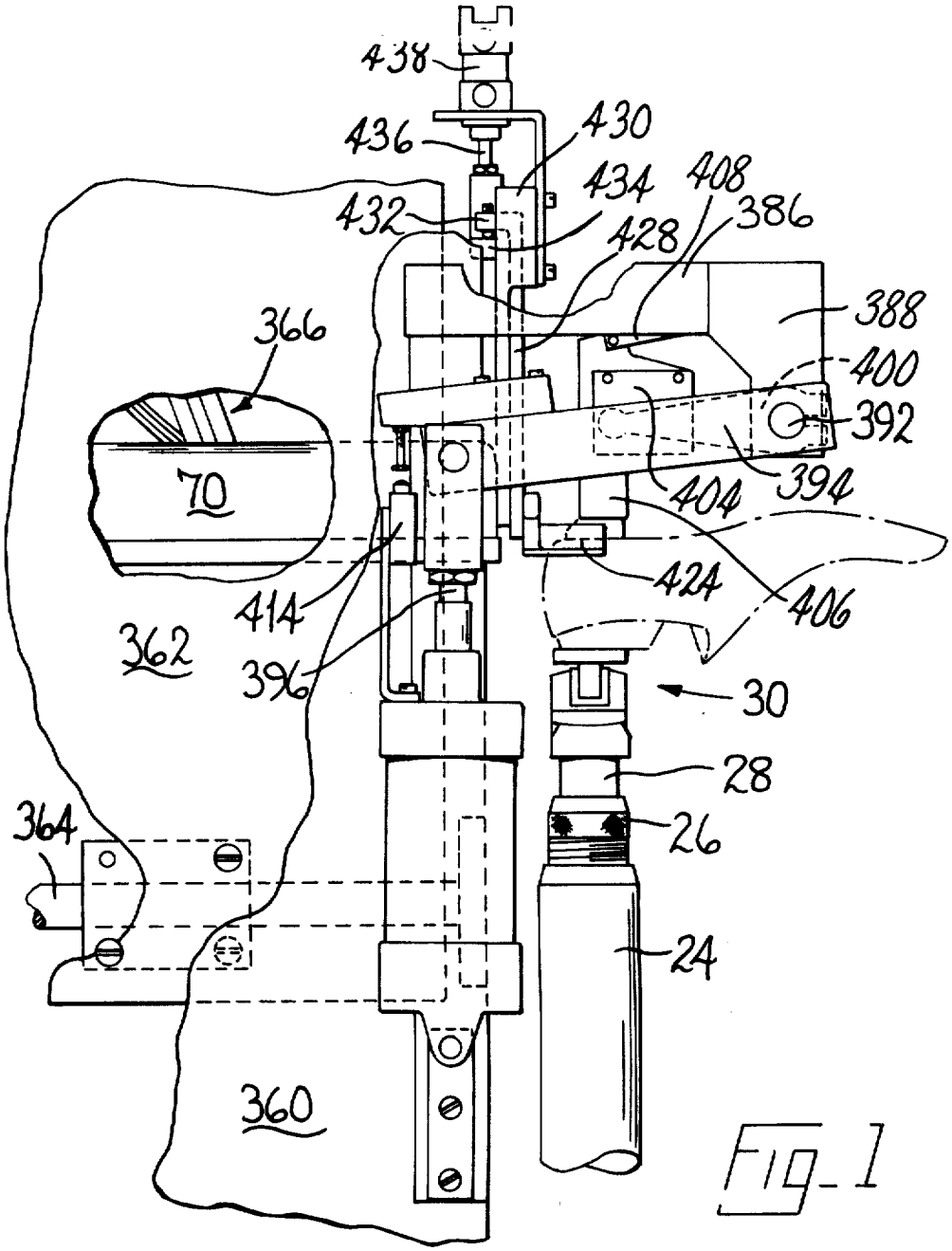
FIG. 1 is a fragmentary left hand side view of the machine in accordance with the invention.
Figure 2:
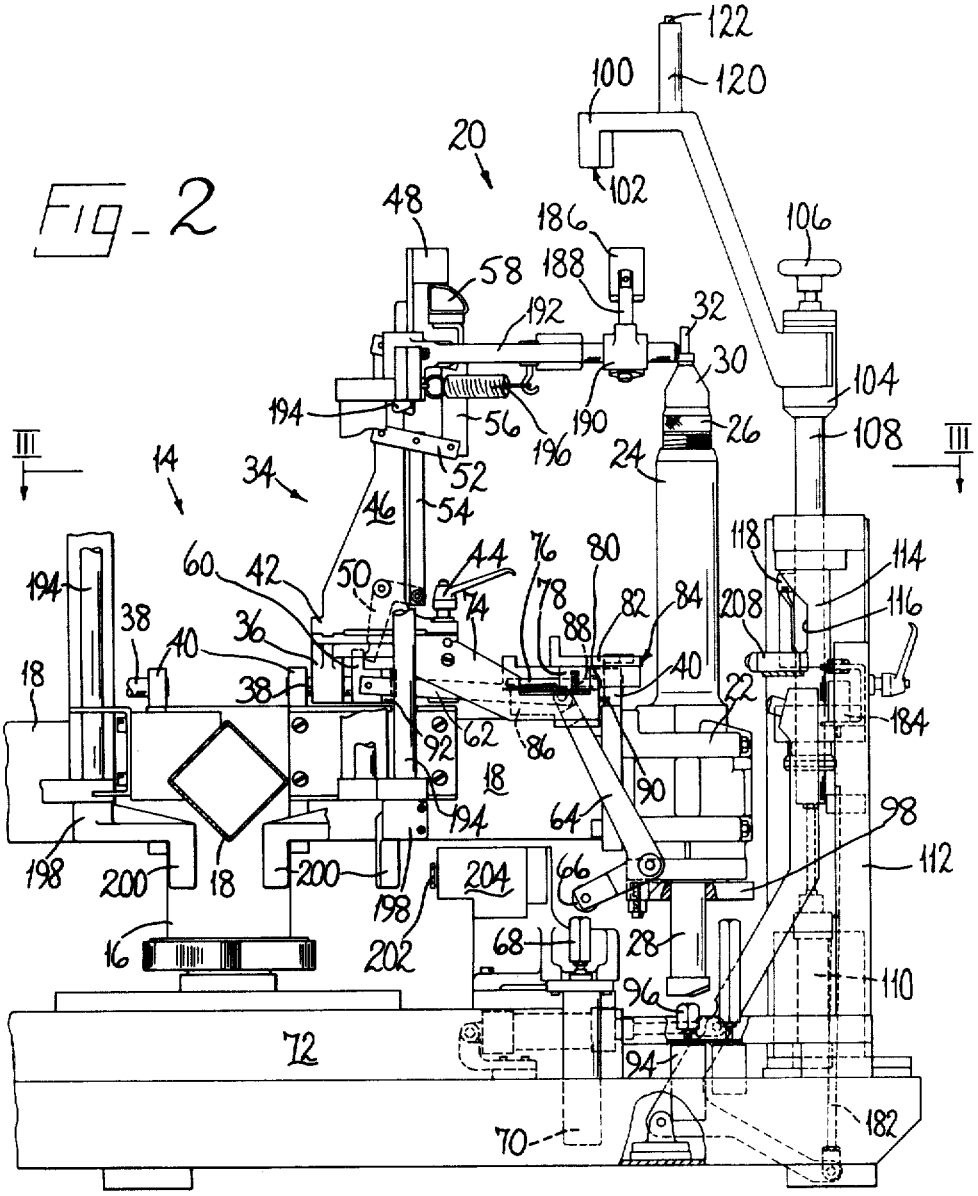
FIG. 2 is a side view of a last support on which a shoe can be presented to heel seat lasting instrumentalities of the machine.

A machine in accordance with the invention is a machine for lasting heel seat portions of shoes using tacks, and in the particular embodiment now to be described forms part of an apparatus for lasting heel seat and side portions of shoe uppers, the machine being arranged at a second operating station, for operating on shoes after a side lasting operation has been effected thereon. The apparatus referred to, furthermore, comprises a turret arrangement supporting four last supports generally designated 22, each last support comprising a mounting 22 including an extending sleeve portion 24, an upper end of which has an adjustable threaded collar portion 26 and which accommodates, for heightwise sliding movement therein, a rod 28 carrying a heel support arrangement generally designated 30, as shown in FIG. 1. The arrangement 30 comprises a last pin 32', shown in FIGS. 2 and 3, which can pivot about an axis extending lengthwise of the shoe bottom. To this end, each last pin 32' is carried in a block 410 which is mounted for limited pivotal movement about a pin 412 carried by a cradle 414. The cradle 414 is slidably mounted in a groove formed in a support block 416, a locking pin 418 being provided for retaining the cradle in adjusted position. The block 416, in turn, has a curved abutment surface which mates with a complementarily curved abutment surface of a further support block 420 which is carried on the rod 28. Locating and locking pins 422 serve to locate and lock the support block 420 in adjusted position. The movement of the support block 420 enables the operator to set the toe-and-heel orientation of a shoe, while the movement of the support block 416 enables the operator to set the longitudinal center line of the heel seat of the shoe in relation to a center line of the loading station A (and also of the second operating station C). The tilting capability of the pin 32' enables last to be properly located on the last support, despite any irregularities in the location and angle of the last pin hole in the last.

Figure 3:
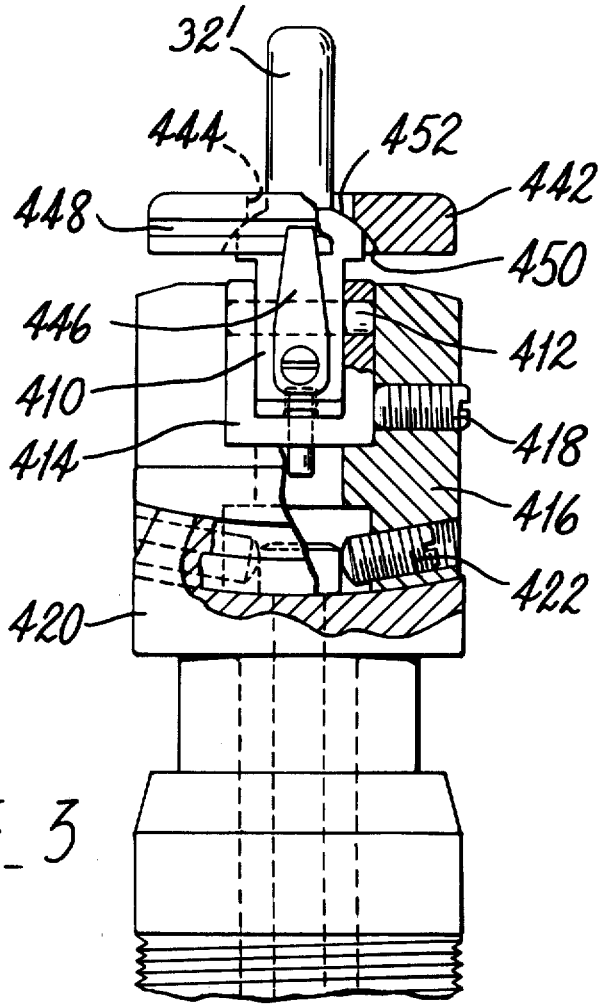
FIG. 3 is a fragmentary view, showing details of the last support, including details of a last pin thereof.
Figure 4:
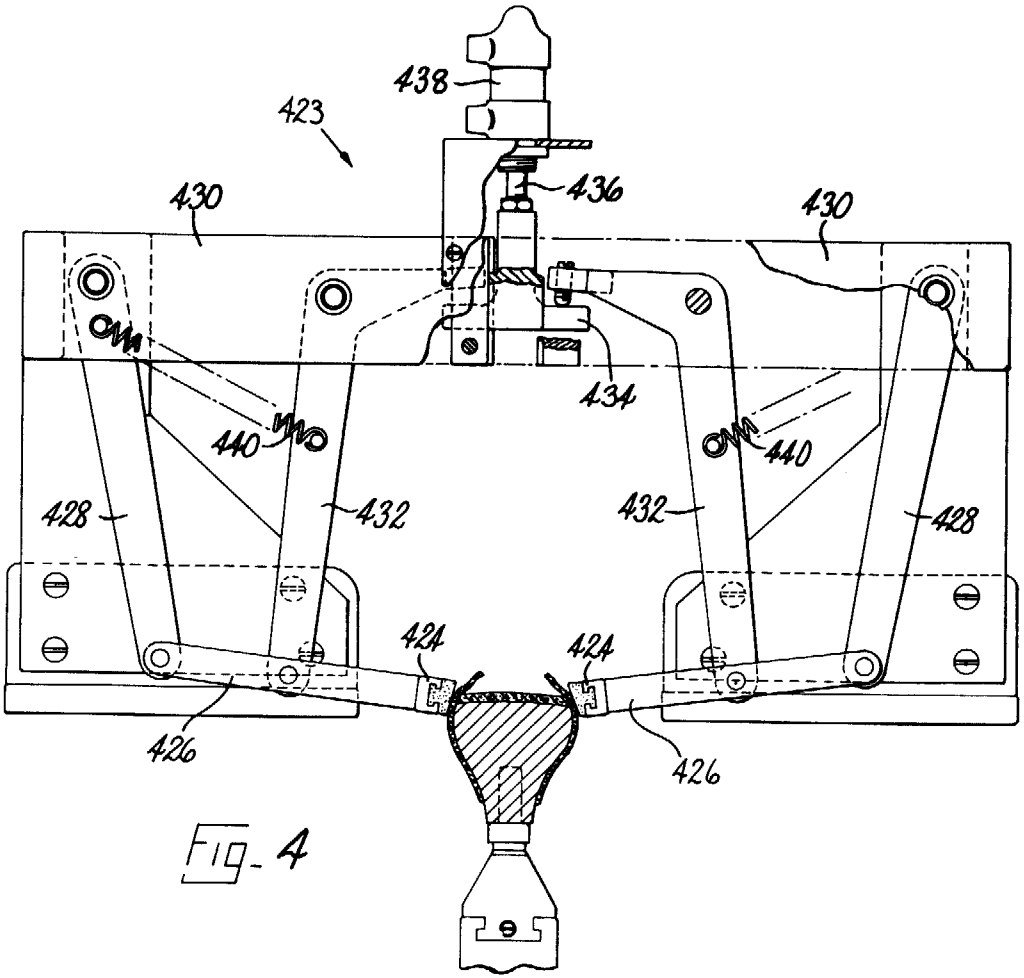
FIG. 4 is a front view of shoe centralizing means.

For supporting the face of the cone of the last, furthermore, each last support also comprises a support plate 442, as shown in FIG. 3, which has an elongated slot 444 through which the pin 32' projects, spring fingers 446 being bolted to opposite sides of the block 410 and engaging in grooves 448 formed at opposite sides of the plate 442, to hold it in position on the block. The underside of the plate 442, furthermore, has a part-spherical recess 450 which enages on a complementarily shaped surface 452 of the block 410 so as to enable the plate to be universally movable relative to the pin 32'. In this way, overall surface engagement can be achieved between the plate 442 and the face of the cone of the last.

Each last support 20 also comprises toe support means generally designated 34 comprising a carriage 36 mounted for sliding movement, towards and away from the sleeve portion 24, on two rods 38 carried by upstanding plates 40 secured to opposite ends of the arm 18. The carriage 36 has a transverse groove accommodating a slide plate 42, locking means 44, including a clamp screw and a slot, being provided for locking the slide plate in adjusted widthwise position. (In this way, the toe support means can be set for a left or a right shoe, desirably the last supports are so set up that left and right shoes are presented alternately to each station). Upstanding from the slide plate are two support plates 46, on upper end portions of which is carried a V-shaped toe end engaging member 48. Also mounted between the support plates 46 is a bell crank lever 50 parallel with an upper arm of which are two parallel levers 52, a link 54 extending between the upper arm of the bell crank lever and said further levers, thus forming a parallel linkage arrangement. Supported between end portions of the levers 52, furthermore, is a support post 56 for a toe pad member 58, which is arranged to engage a toe cap portion of a shoe supported on the last support and located by the toe end engaging member 48.

In the operation of the machine, the toe support means 34 is moved towards the heel support member 30 along the rods 38 until the toe end engaging member 48 engages with the shoe toe, whereupon further movement towards the heel support is terminated. For effecting such movement, a downwardly depending arm of the bell crank lever 50 engages a projection on a block 60 slidable on the rods 38 independently of the carriage 36, there being connected at one end of said block 60 a link 62 connected at its opposite end to one arm of a bell crank lever 64 mounted for pivotal movement on the mounting 22 of the last support. The other arm of the bell crank lever 64 carries a roller 66 which can be engaged by a pusher block 68 carried on a piston rod of a piston-and-cylinder arrangement 70 (constituting first power means of the transporting device) mounted on a frame portion 72 of the transporting device, actuation of said arrangement 70 causing the pusher block to engage the roller and thus to draw the block 60 towards the heel support. Upon termination of movement towards the heel support of the toe end engaging member as aforesaid, continued operation of the arrangement 70 is effective through the parallel linkage arrangement to raise the toe pad 58 into engagement with the shoe.

For locking the toe support means in adjusted position, a plate 92 is slidable on one of the rods 38 and is connected to a heelward face of the block 60 whereby to constitute a bar lock arrangement, said arrangement allowing the toe support means to move towards the heel support, while preventing movement thereof away from said support.

The rod 28 of each last support 20 is mounted for sliding heightwise movement in the sleeve portion 24, thus to bring the heel seat of a shoe supported on the last pin 32 thereof to a datum position. For thus moving the rod 28, there is provided at the loading station A a piston-and-cylinder arrangement 94 a piston rod of which carries a pusher member 96 engageable with a head portion on the lower end of each rod 28. Furthermore, for locking each rod 28 with the heel seat of the shoe in its datum position, a bar lock arrangement is provided comprising a plate 98 which is secured to the under-side of the mounting 22. (The plates 98, 92 respectively constitute first and second locking means of the apparatus.)

For determining the datum position of the heel seat of a shoe at the loading station A, there is provided at said station a heel height determining member 100 in the form of a cranked arm having a downwardly facing heel seat engaging surface 102. The arm 100 is carried by a block 104 which itself is adjustable heightwise, under the control of the operator, using an adjusting screw 106, at the upper end of a shaft 108 which is movable heightwise under the control of a piston-and-cylinder arrangement 110. The shaft 108 is supported in a support column 112, which in turn carries a bush portion 114 having a slot 116 therein which is part-helical and part-vertical. The slot 116 receives a pin 118 carried on the shaft 108, which is slidingly accommodated in the bush portion, so that, as the shaft 108 is moved heightwise, it is rotated between an operative position, in which it is disposed above the last pin 32, and sets the datum position for the heel seat of a shoe supported thereby, and an out-of-the-way position, in which it does not impede the movement of the last supports 20 to and from the loading station A.

For effecting movement of the heel height determining member 100, furthermore, a hand grip 120 thereon has a thumb switch 122 (constituting actuating means). Actuation of the switch 122 is effective, furthermore, not only to bring the member 100 to its operative position, but also to initiate operation of the piston-and-cylinder arrangement 94 (constituting further power means of the apparatus) and also, in sequence, operation of the piston-and-cylinder arrangement 70, thus respectively to raise the rod 28, and last pin 32 therewith, and to initiate heelward movement of the toe support means 34. (It will of course be appreciated that the heel height determining member 100 is moved towards the last support 20 under a higher pressure than that under which the last support 20 is moved heightwise towards the member 100 as aforesaid.)

The machine in accordance with the invention also comprises a main frame 360, shown in FIG. 1, within which a carriage 362 is mounted, for sliding movement towards and away from a shoe presented thereto on its last support 20, on slide rods 364 carried by said frame, the carriage supporting heel seat lasting instrumentalities generally designated 366, and including wiper plates, fastener driving means associated therewith, and a heel band arrangement.

Mounted on the frame 360 is a sub-frame comprising two arms 386, in the form of inverted Ls, forwardly projecting portions of which support a cross member 388. The member 388 has two depending lugs 390, one arranged centrally of said member and the other at one end thereof, said lugs supporting a shaft 392 for limited rotational movement therein. Connected to the outward end of said shaft, by means of a lever 394, is a piston rod 396 of a piston-and-cylinder arrangement 398 mounted on one of the arms 386. Operation of said arrangement 398 is thus effective to rotate the shaft 392. The shaft 392 also supports, adjacent the centrally disposed lug 390, a lever 400, an end of which, remote from the shaft 392, is pivotally connected, by means of a pin 402, to two plates 404, the lever being accommodated between said plates. The plates 404 are bolted to a holddown member 406, which is arranged to engage with the heel seat of a shoe S presented on its last support 20. A further lever 408 is connected at one end to the holddown member 406 and at the other end to a block 410 carried on the cross member 388. The levers 400, 408 together form a parallel linkage arrangement, whereby the movement of the holddown member 406, under the action of the piston-and-cylinder arrangement 398, is maintained substantially vertical. The holddown member 406 constitutes a heel seat presser member by which the shoe S is held secure on the last pin 32 during the heel seat lasting operation.

Figure 5:
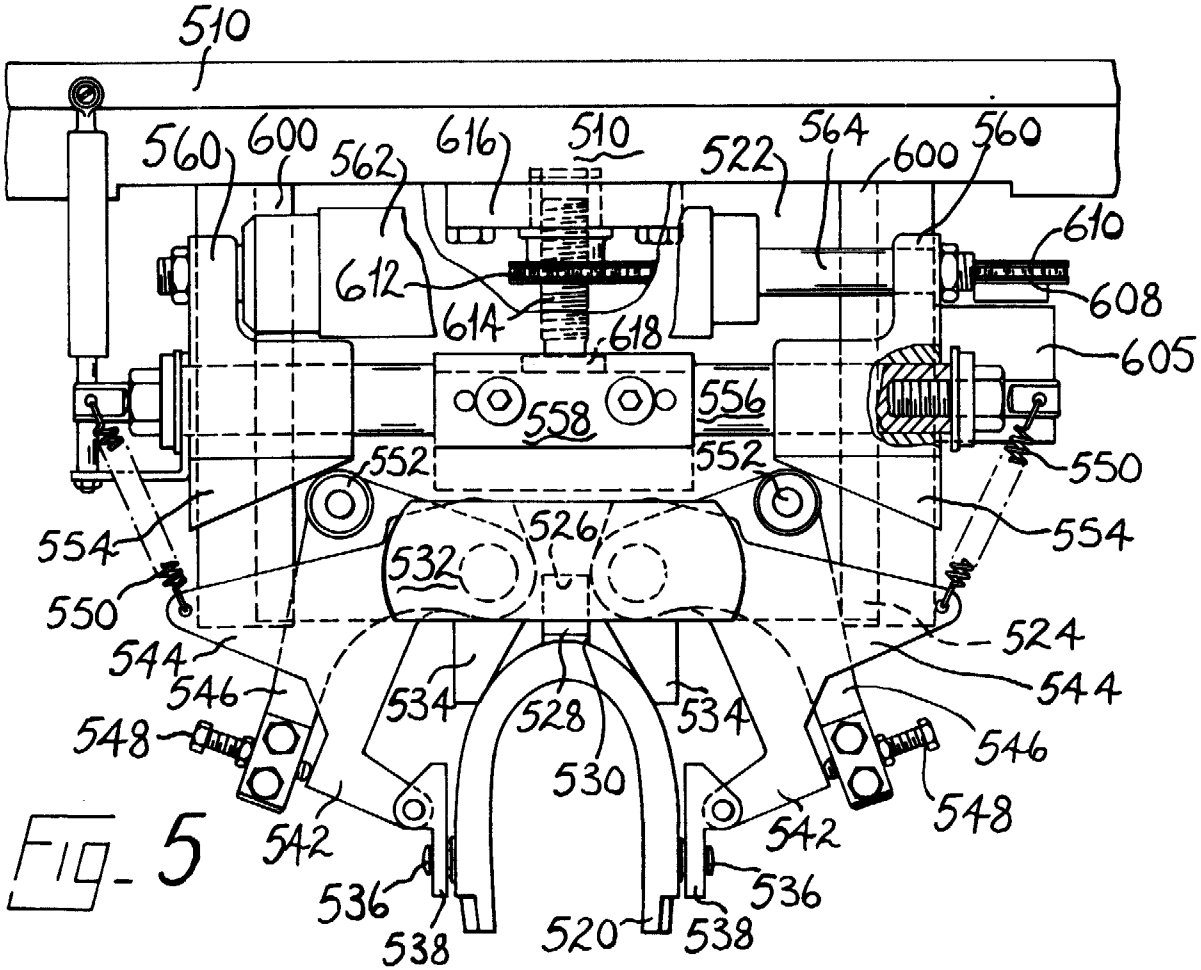
FIG. 5 is a plan view of a heel band arrangement.

The machine in accordance with the invention is generally similar, except as herein described, to that described in our co-pending U.K. patent application No. 8,020,133, except that in the latter machine the shoe is carried on its support into a heel band, the position of which in relation to the heel seat lasting instrumentalities is predetermined, the instrumentalities themselves being mounted in a fixed frame, whereas in the machine in accordance with the present invention the carriage on which the heel seat lasting instrumentalities and heel band arrangement are mounted, is movable while the last support 20 on which the shoe is presented is fixed in relation thereto. Thus, the heel band arrangement comprises a heel band 520, as shown in FIG. 5, support on the carriage 362 by an arrangement now to be described. The arrangement thus comprises a support plate 522 having bolted thereto a plate 524 having a cut-away portion to form a recess 26 for receiving a tab 528 forming part of a support bracket 530 to which the heel band is secured, said band thus being supported in the machine. Secured to the plate 524, through spacers (not shown), is a further plate 532, there being welded to forward edges of said plates 524, 532 two lugs 534 provided with inclined faces against which portions of the heel band adjacent and at opposite sides of the backseam region thereof can abut when the heel band is supported as aforesaid, such inclined faces forming a generally V-shaped.

For urging the "legs" of the heel band into clamping engagement with a shoe, each "leg" has a stud 536 received in an open-ended slot of a presser plate 538 which is pivotally supported, intermediate its length, on a projecting portion 542 of a lever 544. Each lever 544 is pivotally supported, between the plates 524, 532, on one of the spacers, said spacers being arranged on opposite sides of the recess 526. Also mounted on each spacer is a further lever 546 which carries an adjustable stop member 548 arranged to engage with a portion of its associated lever 544, a spring 550 being provided for urging the lever 544 against said stop member. Each lever 546 also carries a roll 552 engageable with an inclined face provided by a wedge member 554, the wedge members 554 being mounted for sliding movement, widthwise of the machine, on a rod 556 secured at its center in a block 558 carried by the support plate 522. Each wedge member 554 has a rearwardly extending lug 560, there being connected to one of said lugs a cylinder 562 of a piston-and-cylinder arrangement and to the other of said lugs a piston rod 564 of said arrangement. The arrangement is double-acting.

Thus, in the operation of the heel band 520, actuation of the piston-and-cylinder arrangement causes the wedge members 554 to move towards one another thereby, through the rolls 552, causing the levers 546, and thus also the levers 544, to pivot to urge the "legs" of the heel band 520 clampingly to engage the shoe. By using a single piston-and-cylinder arrangement acting through the wedge members, a pressure compensating arrangement is thereby achieved in that if one of the "legs" of the heel band engages the shoe before the other, further movement of the wedge member associated with said one "leg" will be resisted, thereby causing the other wedge member to urge its associated "leg" into engagement with the shoe, whereafter the pressure on both "legs" will be equalized.

The effect of thus equalizing the pressure is to militate against any centralizing effect the heel band 520 may have on a shoe presented thereto. By the arrangement above described, it has been found that a shoe is clamped by the heel clamp in the position in which it is presented thereto by the operator.

The machine in accordance with the invention also comprises shoe centralizing means, comprising two forwardly projecting shoe engaging elements 424, arranged for movement between an operative position, in which they can engage opposite side portions of the heel seat of the shoe. One at either side of the last pin 32', and an out-of-the-way position. For moving the elements 424 as aforesaid, each element is carried on a lever 426, which is supported, at an end remote from the element, on a further lever 428 pivotally mounted on a cross member 430 bolted to the front face of the carriage 362. In addition, pivotally connected to an intermediate portion of each lever 426 is one arm of a bell crank lever 432, which again is pivoted on the cross member 430, and the other arm of which is directed inwardly towards a central region of the cross member 430. Each of the other arms of the bell crank levers 432 has an abutment surface portion which engages with a flange member carried on a piston rod 436 of a piston-and-cylinder arrangement 438, said arrangement being carried on the carriage 362. In addition, springs 440, connected between each lever 428 and the carriage 362 urge the element 424 into their out-of-the-way position, operation of the piston-and-cylinder arrangement 438, on the other hand, moving said elements to their operative position. It will thus be appreciated that, because of the arrangement above described, operation of the elements 424 ensures that each moves through the same distance as the other, so that they can effect a centralizing action on a shoe presented therebetween. In the operation of the machine in accordance with the invention, therefore, a shoe is placed on the last pin 32' at the loading station of the apparatus, and the heel height determining member 100 is then moved to its operative condition and the shoe is jacked up to bring the heel seat thereof into engagement with said member. Thereafter the toe support means is moved towards the heel support to bring the toe pad 58 into engagement with the shoe. In this condition, the shoe is properly located in a toe-to-heel orientation. The last support 20 is then moved to the operating stations, at the second of which is arranged heel seating lasting instrumentalities, as above described. On arrival at the second operating station, firstly the shoe centralizing means is caused to operate thus to position the shoe, if necessary by rocking the last pin 32', to bring side portions into a desired relationship with the longitudinal center line of the heel seat lasting instrumentalities. With the shoe centralized as aforesaid, the holddown foot 312 is actuated to clamp the shoe on the last pin in a centralized condition, and the elements of the shoe centralizing means are then moved to an out-of-the-way position. With the shoe thus held, the carriage 362 is then caused to advance, to bring the heel band 420 into clamping engagement with the heel end of the shoe, the shoe centralizing means, which is mounted on the carriage 362, thus being moved out-of-the-way, so as not to impede the side lasting operation. With the shoe clamped by the heel band, the side lasting operation then takes place in a conventional manner.

Whereas the machine in accordance with the invention as just been described forms part of an apparatus including a turret arrangement with a plurality of last supports for successive automatic presentation to the machine, it will be appreciated that in accordance with the invention the machine may comprise a single, fixed, last support located at the operating locality of the machine.

We claim:

1. A machine for lasting heel seat portions of shoes, comprising:

shoe support means, comprising a heel support, including a last pin which is mounted for limited rocking movement about an axis extending heightwise of the bottom of a shoe supported thereby, and toe support means, including a toe support member which can be urged upwardly against the toe cap portion of a shoe supported on the last pin, thus to set the toe-to-heel orientation of the shoe bottom;

shoe centralizing means, comprising two shoe-engaging elements, arranged to engage the heel seat of the shoe at opposite sides of the last pin, said elements being movable through equal distances thus to engage and centralize the shoe in relation to a longitudinal center line of the machine by rocking it together with the last pin, about said axis;

a holddown member which engages the shoe bottom in the heel seat region thereof, while the shoe is held by the shoe centralizing means;

a heel hand arrangement, between which and the shoe support means relative movement of approach can take place, after widthdrawal of the shoe centralizing means, thus to cause the heel end of the shoe engaged by the holddown member to be clamped by a heel band of said arrangement, in the operation of which arrangement equalized pressure is applied to opposite "legs" of the heel band so that the shoe is clamped substantially in the position in which it is presented to the heel band arrangement; and heel seat lasting instrumentalities by which lasting marginal portions of the upper are wiped over and pressed against corresponding marginal portions of the insole.

2. A machine according to claim 1 wherein the heel band arrangement and the heel seat lasting instrumentalities are mounted on a carriage, which is movable towards the last support, thus to bring the heel band into clamping engagement with the shoe, and wherein the shoe centralizing means is also mounted on said carriage, the arrangement being such that the element of the shoe centralizing means moved to an out-of-the-way position prior to initiation of the movement of the carriage.

3. A machine according to claim 2 wherein the elements are resiliently urged into their out-of-the-way positions, fluid pressure operated means being provided for moving them into operative position.

4. A machine according to claim 3 wherein heel band actuating means is provided, comprising two lever arrangements acting one on each "leg" of the heel band, for moving said "legs" against opposite sides of the heel end of a shoe carried by the shoe support, thus to clamp the shoe thereon, said means also comprising a pressure compensating arrangement whereby the pressure applied to the "legs" by said means is equalized, each lever arrangement being actuated by a wedge member movable relative thereto, and the pressure compensating arrangement comprising a piston-and-cylinder arrangement mounted between the two wedge members and effective to cause them to be moved relative to the lever arrangements.

5. A machine according to claim 4 wherein each lever arrangement comprises a first lever acting on the "leg" of the heel band and a second lever engageable by the wedge member, the two levers being pivoted on a common axis and adjustable stop means being provided for varying the angular relationship therebetween.

6. A machine according to claim 5 wherein the heel band is fixedly supported at its backseam region and two fixed backing surfaces provide additional support at opposite sides thereof adjacent the backseam region.

* * * * *